US009786102B2

(12) United States Patent
Bullister et al.

(10) Patent No.: US 9,786,102 B2
(45) Date of Patent: Oct. 10, 2017

(54) SYSTEM AND METHOD FOR WIRELESS VEHICLE CONTENT DETERMINATION

(71) Applicant: Ford Global Technologies, LLC, Dearborn, MI (US)

(72) Inventors: Kevin Michael Bullister, Dexter, MI (US); David Chronowski, Harrison Township, MI (US); Thomas Woloszyn, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 726 days.

(21) Appl. No.: 13/832,318

(22) Filed: Mar. 15, 2013

(65) Prior Publication Data

US 2014/0277828 A1 Sep. 18, 2014

(51) Int. Cl.
*G07C 5/00* (2006.01)
*G07C 5/08* (2006.01)

(52) U.S. Cl.
CPC ..... *G07C 5/008* (2013.01); *G07C 5/0816* (2013.01)

(58) Field of Classification Search
CPC ..... H04W 88/00; H04B 7/26; G06F 17/30; G06F 9/44; H04M 1/7253
See application file for complete search history.

(56) References Cited

U.S. PATENT DOCUMENTS 5,781,125 A 7/1998 Godau et al.
5,922,041 A 7/1999 Anderson
6,064,322 A 5/2000 Ohira
6,337,621 B1 1/2002 Ogino et al.
6,356,839 B1 3/2002 Monde et al.
(Continued)

FOREIGN PATENT DOCUMENTS

EP 0808492 8/1996
JP 9264819 10/1997
(Continued)

OTHER PUBLICATIONS

Kermit Whitfield, "A hitchhiker's guide to the telematics ecosystem", Automotive Design & Production, Oct. 2003, http://findarticles.com, pp. 1-3.
(Continued)

*Primary Examiner* — Todd Melton
*Assistant Examiner* — Jason Roberson
(74) *Attorney, Agent, or Firm* — Jennifer Stec; Brooks Kushman P.C.

(57) ABSTRACT

A fleet management system providing a manager with a tailored user interface based on the enabled features recognized in a vehicle. The fleet management system may monitor two or more vehicles, wherein each vehicle may have one or more processors. The one or more processors may receive an initialization signal from the fleet management system. The one or more processors may perform a query of one or more vehicle modules for enabled features in response to the initialization signal received from the fleet management system. The query of enabled vehicle features may be based on one or more criteria. The system may transmit to a server a signal indicating the enabled vehicle features installed in the vehicle. The system may output the enabled vehicle features to a user while tailoring the user screen data based on the enabled features.

8 Claims, 7 Drawing Sheets

(56) References Cited

U.S. PATENT DOCUMENTS

| | | | | |
|---|---|---|---|---|
| 6,434,455 | B1 | 8/2002 | Snow et al. | |
| 6,553,292 | B2 | 4/2003 | Kokes et al. | |
| 6,598,183 | B1 | 7/2003 | Grieco et al. | |
| 6,603,394 | B2 | 8/2003 | Raichle et al. | |
| 6,611,740 | B2 | 8/2003 | Lowrey et al. | |
| 6,611,755 | B1 * | 8/2003 | Coffee et al. | 701/482 |
| 6,636,790 | B1 | 10/2003 | Lightner et al. | |
| 6,687,587 | B2 | 2/2004 | Kacel | |
| 6,738,697 | B2 | 5/2004 | Breed | |
| 6,778,888 | B2 | 8/2004 | Cataldo et al. | |
| 6,978,198 | B2 | 12/2005 | Shi | |
| 7,146,307 | B2 | 12/2006 | Mocek | |
| 7,155,321 | B2 | 12/2006 | Bromley et al. | |
| 7,209,490 | B2 | 4/2007 | Isaac et al. | |
| 7,228,211 | B1 | 6/2007 | Lowrey et al. | |
| 7,232,962 | B2 | 6/2007 | Rynd | |
| 7,277,780 | B2 | 10/2007 | Meier-Arendt et al. | |
| 7,340,365 | B2 | 3/2008 | Wubbena et al. | |
| 7,343,526 | B2 | 3/2008 | Aditham | |
| 7,356,394 | B2 | 4/2008 | Burgess | |
| 7,366,934 | B1 | 4/2008 | Narayan et al. | |
| 7,379,541 | B2 | 5/2008 | Iggulden et al. | |
| 7,487,074 | B2 | 2/2009 | Ohtsu et al. | |
| 7,493,209 | B1 | 2/2009 | Altrichter et al. | |
| 7,522,995 | B2 | 4/2009 | Nortrup | |
| 7,532,962 | B1 | 5/2009 | Lowrey et al. | |
| 7,590,476 | B2 | 9/2009 | Shumate | |
| 7,905,815 | B2 | 3/2011 | Ellis et al. | |
| 7,983,839 | B2 | 7/2011 | Sutardja | |
| 8,024,111 | B1 | 9/2011 | Meadows et al. | |
| 8,103,443 | B2 | 1/2012 | Kantarjiev et al. | |
| 8,126,644 | B2 | 2/2012 | Amano | |
| 8,140,358 | B1 | 3/2012 | Ling et al. | |
| 8,185,299 | B2 | 5/2012 | Fujiwara et al. | |
| 8,219,249 | B2 | 7/2012 | Harrod et al. | |
| 8,285,439 | B2 | 10/2012 | Hodges | |
| 8,315,802 | B2 | 11/2012 | Brown | |
| 8,364,402 | B2 | 1/2013 | Ross et al. | |
| 8,390,473 | B2 | 3/2013 | Krzyzanowski et al. | |
| 8,392,105 | B2 | 3/2013 | Desborough | |
| 2002/0035429 | A1 | 3/2002 | Banas | |
| 2002/0173885 | A1 | 11/2002 | Lowrey et al. | |
| 2003/0034769 | A1 | 2/2003 | Lipscomb et al. | |
| 2003/0036832 | A1 | 2/2003 | Kokes et al. | |
| 2003/0163587 | A1 | 8/2003 | Knight et al. | |
| 2004/0024502 | A1 | 2/2004 | Squires et al. | |
| 2004/0044454 | A1 | 3/2004 | Ross et al. | |
| 2004/0054503 | A1 | 3/2004 | Namaky | |
| 2004/0093134 | A1 | 5/2004 | Barber et al. | |
| 2004/0128071 | A1 | 7/2004 | Schradi | |
| 2004/0172177 | A1 | 9/2004 | Nagai et al. | |
| 2004/0194479 | A1 | 10/2004 | Umebayashi et al. | |
| 2004/0218894 | A1 | 11/2004 | Harville et al. | |
| 2005/0090939 | A1 | 4/2005 | Mills et al. | |
| 2005/0096020 | A1 | 5/2005 | Oesterling | |
| 2005/0097541 | A1 | 5/2005 | Holland | |
| 2005/0192724 | A1 | 9/2005 | Hendry | |
| 2005/0281414 | A1 | 12/2005 | Simon et al. | |
| 2006/0034231 | A1 | 2/2006 | Tailor | |
| 2006/0041348 | A1 | 2/2006 | Liebl et al. | |
| 2006/0130033 | A1 | 6/2006 | Stoffels et al. | |
| 2006/0132291 | A1 | 6/2006 | Dourney, Jr. et al. | |
| 2006/0155437 | A1 | 7/2006 | Wang et al. | |
| 2006/0229777 | A1 | 10/2006 | Hudson et al. | |
| 2006/0253235 | A1 | 11/2006 | Bi et al. | |
| 2007/0121959 | A1 | 5/2007 | Philipp | |
| 2007/0162796 | A1 | 7/2007 | Chan et al. | |
| 2007/0171029 | A1 | 7/2007 | Inbarajan | |
| 2007/0179799 | A1 | 8/2007 | Laghrari | |
| 2008/0015748 | A1 | 1/2008 | Nagy | |
| 2008/0027605 | A1 | 1/2008 | Oesterling | |
| 2008/0027606 | A1 | 1/2008 | Helm | |
| 2008/0082226 | A1 | 4/2008 | Amador et al. | |
| 2008/0140281 | A1 | 6/2008 | Morris et al. | |
| 2008/0147267 | A1 | 6/2008 | Plante et al. | |
| 2008/0162033 | A1 | 7/2008 | Wagner et al. | |
| 2008/0167056 | A1 | 7/2008 | Gilzean et al. | |
| 2008/0167078 | A1 | 7/2008 | Eibye | |
| 2008/0172357 | A1 | 7/2008 | Rechis et al. | |
| 2008/0216067 | A1 | 9/2008 | Viling | |
| 2008/0269975 | A1 | 10/2008 | Bertosa et al. | |
| 2009/0063038 | A1 | 3/2009 | Shrivathsan et al. | |
| 2009/0063045 | A1 | 3/2009 | Figueroa et al. | |
| 2009/0143937 | A1 | 6/2009 | Craig | |
| 2009/0177352 | A1 | 7/2009 | Grau et al. | |
| 2009/0177506 | A1 * | 7/2009 | Jiang | 705/7 |
| 2009/0210145 | A1 | 8/2009 | Amano | |
| 2009/0276115 | A1 | 11/2009 | Chen | |
| 2009/0292416 | A1 | 11/2009 | Ubik et al. | |
| 2009/0308134 | A1 | 12/2009 | Pepper | |
| 2009/0326757 | A1 | 12/2009 | Andreasen et al. | |
| 2009/0326949 | A1 | 12/2009 | Douthitt et al. | |
| 2009/0326991 | A1 | 12/2009 | Wei et al. | |
| 2010/0042287 | A1 | 2/2010 | Zhang et al. | |
| 2010/0042288 | A1 | 2/2010 | Lipscomb et al. | |
| 2010/0056055 | A1 | 3/2010 | Ketari | |
| 2010/0082559 | A1 * | 4/2010 | Sumcad et al. | 707/695 |
| 2010/0204878 | A1 | 8/2010 | Drew et al. | |
| 2010/0245123 | A1 | 9/2010 | Prasad et al. | |
| 2010/0246846 | A1 | 9/2010 | Burge et al. | |
| 2010/0256861 | A1 | 10/2010 | Hodges | |
| 2010/0262335 | A1 | 10/2010 | Brozovich | |
| 2011/0022422 | A1 | 1/2011 | Taylor | |
| 2011/0041088 | A1 | 2/2011 | Mason et al. | |
| 2011/0046883 | A1 | 2/2011 | Ross et al. | |
| 2011/0190962 | A1 | 8/2011 | Peterson et al. | |
| 2011/0201302 | A1 | 8/2011 | Hatton | |
| 2011/0225096 | A1 | 9/2011 | Cho et al. | |
| 2011/0258044 | A1 | 10/2011 | Kargupta | |
| 2011/0276218 | A1 | 11/2011 | Dwan et al. | |
| 2011/0276219 | A1 | 11/2011 | Swaminathan et al. | |
| 2012/0029762 | A1 | 2/2012 | Ubik et al. | |
| 2012/0030512 | A1 | 2/2012 | Wadhwa et al. | |
| 2012/0053782 | A1 | 3/2012 | Gwozdek et al. | |
| 2012/0072055 | A1 | 3/2012 | Barlsen et al. | |
| 2012/0075092 | A1 | 3/2012 | Petite et al. | |
| 2012/0264376 | A1 * | 10/2012 | Breed | 455/66.1 |
| 2012/0294238 | A1 | 11/2012 | Uhler | |

FOREIGN PATENT DOCUMENTS

| | | |
|---|---|---|
| JP | 11326140 | 11/1999 |
| JP | 2006018680 | 1/2006 |

OTHER PUBLICATIONS

Ford Motor Company, "SYNC with Navigation System," Owner's Guide Supplement, SYNC System Version 1 (Jul. 2007).

Ford Motor Company, "SYNC," Owner's Guide Supplement, SYNC System Version 1 (Nov. 2007).

Ford Motor Company, "SYNC with Navigation System," Owner's Guide Supplement, SYNC System Version 2 (Oct. 2008).

Ford Motor Company, "SYNC," Owner's Guide Supplement, SYNC System Version 2 (Oct. 2008).

Printout from http://www.core77.com/greenergadgets/entry, Tweet-a-Watt, A twittering power meter, Limor Fried, Adafruit Industries & Phillip Torrone MAKE magazine (United States).

Printout from http://hackaday.com/2009/01/02/twittering-washing-machine/, Twitter washing machine.

Printout from http://www.intomobile.com/2008/07/19/twinkle-hits-appstore-location-based-twitter-client, Client for iPhone.

Printout from http://www.tuae.com/2008/04/22/twinkle-geolocational-twitter-on-iphone, Twinkle: location-aware Twitter client for iPhone.

Printout from http://www.iphonehacks.com/2008/04/twitter-twinkle.html, Twinkle—iPhone Twitter App adds Location Feature.

Ford Motor Company, "SYNC with Navigation System," Owner's Guide Supplement, SYNC System Version 3 (Jul. 2009).

Ford Motor Company, "SYNC," Owner's Guide Supplement, SYNC System Version 3 (Aug. 2009).

(56) References Cited

OTHER PUBLICATIONS

"Drew Tech gets you on the Bus", article printed from www.drewtech.com, Dec. 16, 2009.
The CarDAQ-Plus Advantage, Drew Technologies, Inc.
Software, Pass Thru Pro II, J2534 Flash Reprogramming, printed from buy1.snapon.com, Dec. 3, 2009.
Integrated Diagnostic System (IDS), Ford, Lincoln, Mercury.
Pegisys PC Diagnostic System, PC-based J2534 Reprogramming & Scan Tool, printed from www.otctools.com.
Introduction to J2534 and Flash Reprogramming, Drew Technologies, Copyright 2009.
Dynetics Vehicle Data Recorder Models DVG-II and WDVG-II (2009) printout from www.dynetics-ia.com.

* cited by examiner

SYSTEM AND METHOD FOR WIRELESS VEHICLE CONTENT DETERMINATION

TECHNICAL FIELD

This invention relates generally to a vehicle computing system and methods for determining, organizing, managing, and transmitting vehicle features and functions for a fleet management system.

BACKGROUND

U.S. Patent Application 2009/0326991 generally discloses a fleet management system has a chauffeur or driver module and a communication and positioning module associated with each fleet vehicle, and a backend monitoring and control system located at a fleet data center in communication with each vehicle. The system monitors each trip automatically and generates time stamps at the start of a trip, a pick up location, a drop off location, and return of the vehicle to a garage at the end of a trip. Vehicle status information is collected and stored along with timestamps. The information is used to generate billing and payroll accounts, and also in monitoring conditions of fleet vehicles and generating alerts as needed. Turn-by-turn route instructions are provided to drivers by voice output on request.

U.S. Pat. No. 7,356,394 generally discloses a Radio Frequency Identification (RFID) vehicle management system and method. For example, an RFID tag may be coupled with a particular vehicle and operable to store identifying information associated with the vehicle and to automatically communicate the identifying information to an RFID tag reader via a wireless communication. In another example, the method may include querying a first RFID tag coupled with a first vehicle for identifying information of the first vehicle. A second RFID tag coupled with a second vehicle for second identifying information of the second vehicle. The first identifying information and the second identifying information is dynamically communicated to a user.

U.S. Pat. No. 7,209,490 generally discloses an apparatus and method for rapidly providing activity on a vehicle network bus including a node having a bus connection. The node includes a Rapid Response Stack loaded with the predetermined message to respond to any network bus request before the application is up and running. A true stack is loaded with real messages from the application once it is booted up and running on the node, whereupon the application subsequently responds to network bus requests using the true stack instead of the Rapid Response Stack.

SUMMARY

In a first illustrative embodiment, a fleet management system providing a manager with a tailored user interface based on the enabled features recognized in a vehicle. The fleet management system may monitor two or more vehicles, wherein each vehicle may have one or more processors. The one or more processors may receive an initialization signal from the fleet management system. The one or more processors may perform a query of one or more vehicle modules for enabled features on the module in response to the initialization signal received from the fleet management system. The query of enabled vehicle features may be based on one or more criteria. The system may transmit to a server a signal indicating the enabled vehicle features installed in the vehicle. The system may output the enabled vehicle features to a user while tailoring the user screen data based on the enabled features.

In a second illustrative embodiment, a non-transitory computer readable encoded with a computer program for providing instructions to direct one or more computers to wirelessly receive a initialization signal from the fleet management system to determine features enabled on a vehicle. The computer-implemented medium may perform a query of one or more vehicle modules for enabled features installed in the vehicle in response to the initialization signal. The computer program may perform the query on a module based on one or more criteria to determine whether a vehicle feature is enabled in the vehicle. The computer program may wirelessly transmit to a server a signal indicating the enabled features.

In a third illustrative embodiment, a method for providing determining vehicle feature content and transmitting the information to a fleet management system. The method may have a vehicle computing system wirelessly receive an initialization signal from a fleet management system. The method may establish communication of one or more vehicle modules using a vehicle data bus and being to perform a query of the one or more vehicle modules for enabled features installed in a vehicle. The query process may begin in response to the initialization signal received by the vehicle computing system. The method may query the one or more vehicle modules based on one or more criteria. The method may wirelessly transmit to a server a signal indicating the enabled vehicle features installed in the vehicle. The method may output the enabled vehicle features to a user of the fleet management system.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
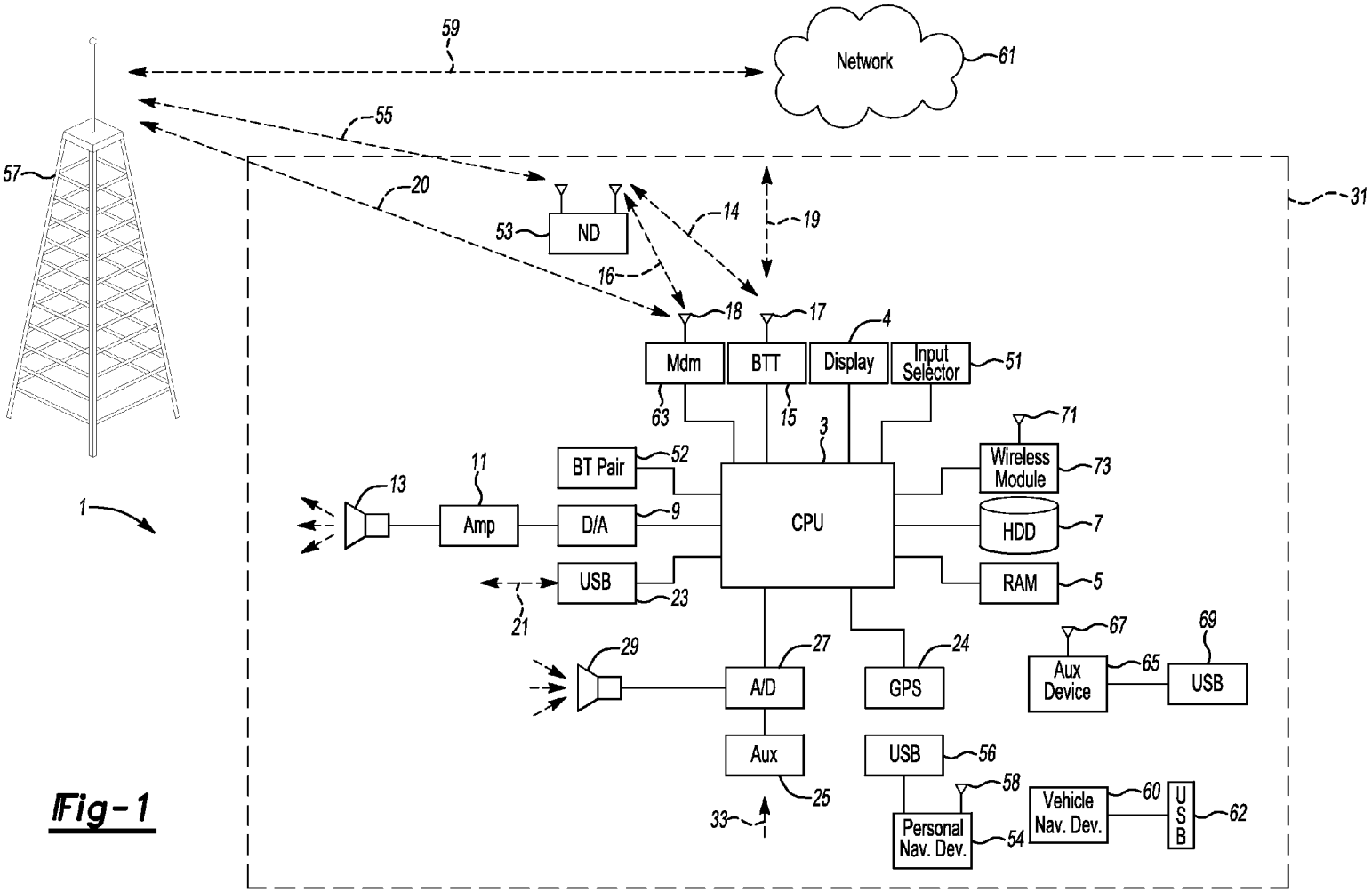
FIG. 1 is an exemplary block topology of a vehicle infotainment system implementing a user-interactive vehicle information display system.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, spoken dialog system with automatic speech recognition and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory. In general, persistent (non-transitory) memory can include all forms of memory that maintain data when a computer or other device is powered down. These include, but are not limited to, HDDs, CDs, DVDs, magnetic tapes, solid state drives, portable USB drives and any other suitable form of persistent memory.

The processor is also provided with a number of different inputs allowing the user to interface with the processor. In this illustrative embodiment, a microphone 29, an auxiliary input 25 (for input 33), a USB input 23, a GPS input 24, screen 4, which may be a touchscreen display, and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a CAN bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device.

Data may be communicated between CPU 3 and network 61 utilizing, for example, a data-plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device). BLUETOOTH is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as IrDA) and non-standardized consumer IR protocols.

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of Code Domain Multiple Access (CDMA), Time Domain Multiple Access (TDMA), Space-Domain Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (FireWire™ (Apple), i.LINK™ (Sony), and Lynx™ (Texas Instruments)), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU could be in communication with a variety of other auxiliary devices 65. These devices can be connected through a wireless 67 or wired 69 connection. Auxiliary device 65 may include, but are not limited to, personal media players, wireless health devices, portable computers, and the like.

Also, or alternatively, the CPU could be connected to a vehicle based wireless router 73, using for example a WiFi (IEEE 803.11) 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process has a step of sending or receiving information with a paired wireless device, then it is likely that the wireless device is not performing the process, since the wireless device would not "send and receive" information with itself. One of ordinary skill in the art will understand when it is inappropriate to apply a particular VACS to a given solution. In all solutions, it is contemplated that at least the vehicle computing system (VCS) located within the vehicle itself is capable of performing the exemplary processes.

Figure 2:
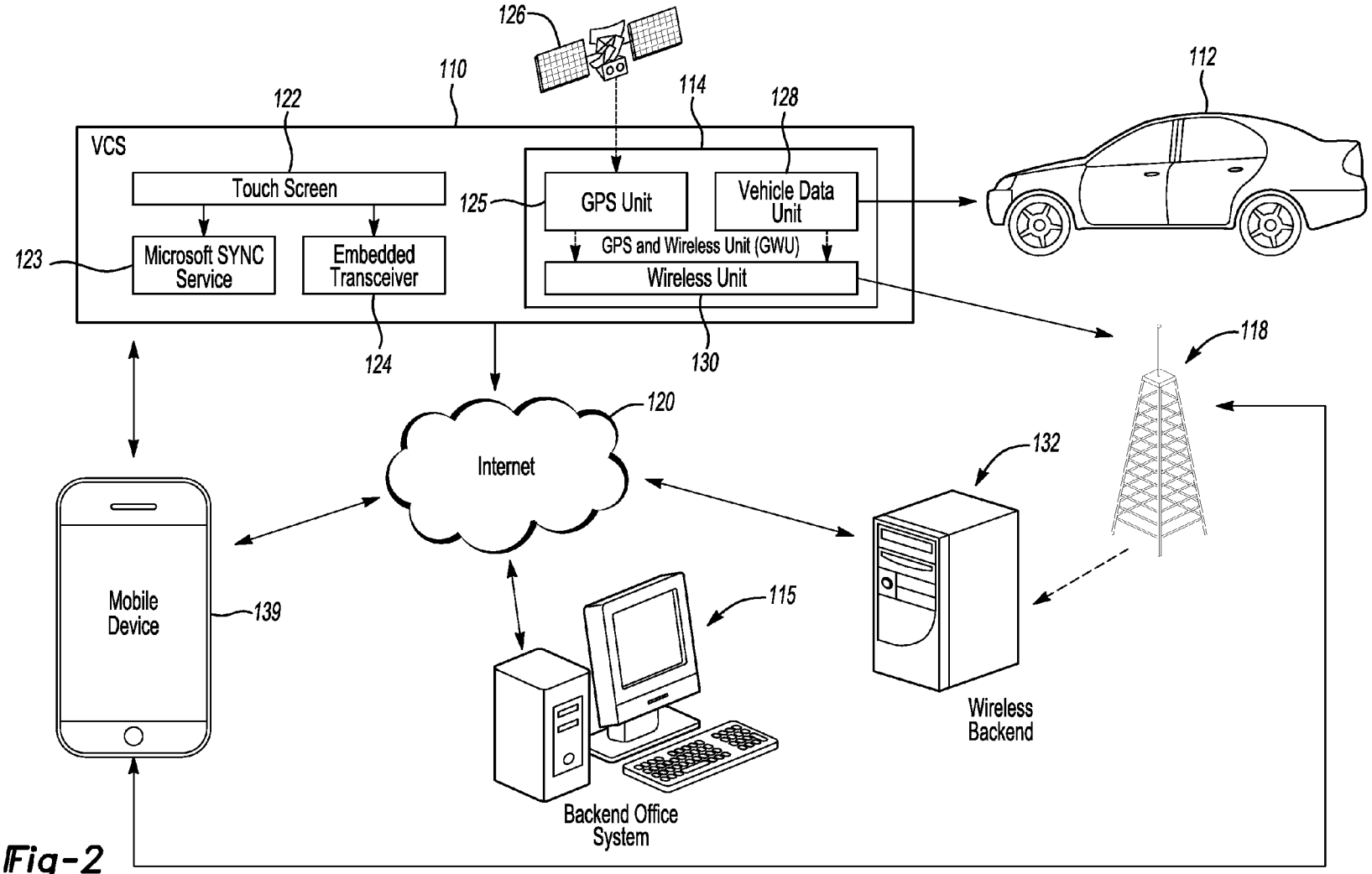
FIG. 2 is an is a detailed block diagram of the components of a fleet management system.

As illustrated in FIG. 2, the system comprises a VCS 110 communicating with a GPS and Wireless Unit (GWU) 114 which is located in a vehicle 112. The GPS and Wireless Unit (GWU) may include, but is not limited to, a Global Positioning System 125 and a wireless communication module 130. The VCS may communicate data to a remote back end office (BOS) or control system 115 located at a data or management center. The BOS 115 communicates with GWU module 114 and/or mobile device 139 via any suitable wireless network 118, and/or via the Internet 120. The wireless network 118 may be a cellular network, a wireless wide area network (WWAN), a WiFi network, an Institute of Electrical and Electronics Engineers, Inc. (IEEE) 802.16 or WiMAX network, or other type of wireless network that employs any variety of wireless technology. The GWU module 114 is also linked to the vehicle's on-board computer system in any suitable manner, such as a direct or indirect wire links or wireless links. Direct wire links may include a universal serial bus (USB) cable, a firewire cable, an RS-232 cable, or the like. Indirect wired links may include a packet switched or circuit switched network connection, an Ethernet network connection, a dial up modem connection, or the like. Wireless links may include an infrared link, a BLUETOOTH link, an Institute of Electrical and Electronics Engineers, Inc. (IEEE) 802.11 point-to-point link, an IEEE 802.16 or WiMAX link, a cellular link, or the like.

The VCS 110 may communicate with a handheld mobile device 139 and/or embedded touch screen device 122, which helps drivers to complete their routes and update the route status. The mobile device may include, but is not limited to, a cellular phone, a computer tablet, and/or a laptop computer. The VCS 110 may automatically confirm the route status when vehicle reaches the scheduled locations (i.e. pickup location, stops, client destination or in-bound garage). Alternatively, the driver can manually confirm the status or confirm the status by voice input if needed. Every time route status changes (e.g. from garage out to pickup arrival or route started) VCS 110 triggers the backend system to stamp the time and save the GPS location for the status change. After the service is completed, every important step in the route is recorded. VCS 110 may also provide a set of Mobile Kiosk functionalities, which can automatically log tolls, fees and can manually log extra passengers, requested stops and passenger rating/feedbacks. Most importantly, VCS 110 may include a sync service module 123 which may be a Microsoft® sync service, and an embedded transceiver 124 which provides communication to a mobile device 139 having one or more navigation application allowing for turn by turn directions (via both graphical user interface and audio speeches) to the pick-up location or passengers' destinations if requested.

The GPS (Global Positioning System) and Wireless (GWU) module 114 is a hardware unit physically installed inside a fleet of service vehicles. This device provides key data about the vehicle, which includes, but is not limited to, ignition On/Off status, real-time vehicle location, real-time vehicle mileage, vehicle speed, vehicle direction, gasoline gauge reading, tire-pressure reading, engine diagnostics reading, maintenance data reading and theft protection features. In one embodiment, the GWU subsystem includes three components, as illustrated in FIG. 2. The first component is a GPS unit 125 which calculates the vehicle's GPS coordinates (longitude and latitude) using signals from GPS satellite 126 in a known manner. This unit also calculates vehicle direction (i.e. heading south, or north etc) and vehicle speed. The update rate may be up to every 1 minute. This information is provided to BOS 115 at scheduled times.

The second component of the GWU 114 is a vehicle data collection unit 128, which is hotwired with the VCS 110. It may read vehicle mileage, gasoline gauge, tire pressure (if equipped) and vehicle diagnostics data in real time. These data are critical for updating maintenance record, scheduling next maintenance, finding potential problems and reporting misconducts. This data may be communicated to the BOS 115 using the mobile device communicating with the VCS using wireless technology. The wireless technology may include, but is not limited to, BLUETOOTH technology.

The third component of GWU 114 is a wireless communication unit 130, which is responsible for sending out the important data collected from GPS unit 125 and vehicle data unit 128 to a local wireless carrier's backend server 132. The data is retrieved by Backend Office System (BOS) 115 as needed. This unit also accepts text messages for configuring the GPS and vehicle data collection units and for theft protection features including forced engine off (if the vehicle's central computer system supports this feature). In another embodiment, the transceiver 124 may communicate the data collected from GPS unit 125 and vehicle data unit 128 to a mobile device 139. The mobile device 139 may receive the data collected and transmit the data to a wireless carrier's backend server 132.

In another embodiment, the GWU module may have one or more components being implemented on the mobile device 139 communicating with the VCS 110 using wireless technology. The one or more components may communicate vehicle data to and from the VCS 110 while performing the analysis on an in-vehicle paired mobile device communicating with the VCS, before being transmitted to the BOS 115. The mobile device may have one or more software applications to perform key vehicle data collection, GPS analysis, and/or other VCS data for wireless transmission to the backend server 132.

GPS data and vehicle data are tracked and recorded periodically (based on the refresh rate setting, which may be up to every minute). These data are sent to BOS system 115 (along with time stampings collected via VCS) to generate maintenance reports/request, billing statements, payrolls, waybills and so on.

Figure 3:
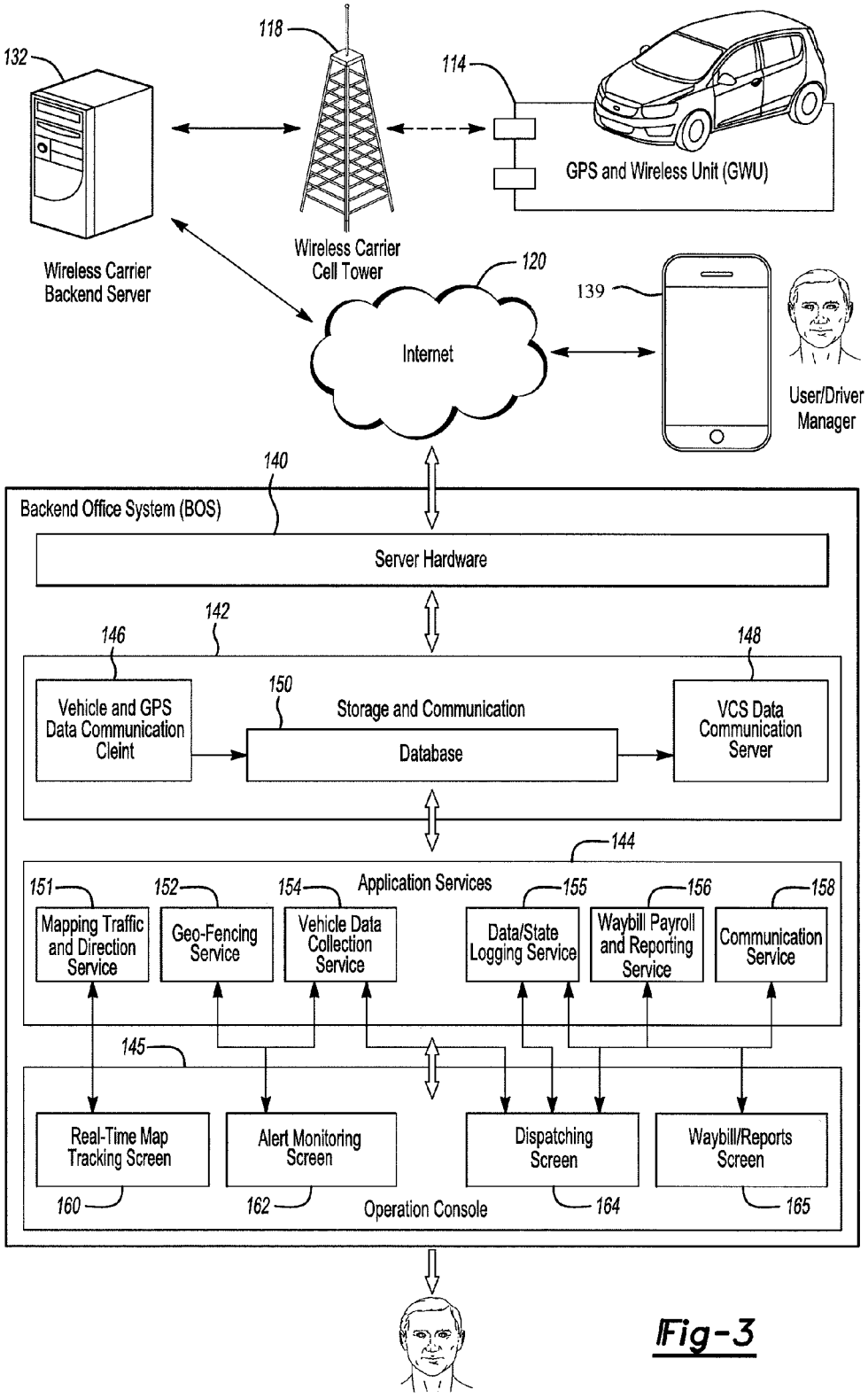
FIG. 3 is a more detailed block diagram of the back end office system or control system of the fleet management system.

The backend office system (BOS) module or subsystem 115 is illustrated in more detail in FIG. 3, and provides a user interface for fleet live (real-time) map tracking, fleet status monitoring, service delay alerts, vehicle malfunction/misconduct alerts, geo-fencing alerts and service re-scheduling/re-dispatching in case of emergencies. This system may be installed on a local server at data center which is linked to the VCS module over the Internet. The BOS 115 has communication interface with VCS devices via the internet, as illustrated in FIGS. 2 and 3, to provide services requested from drivers, for an instance, turn by turn direction guide, traffic updates, route status updates, log timestamps etc. The BOS module 115 is also responsible for getting GPS and vehicle data (in real-time) for each of the vehicles that are currently out on jobs from the wireless carrier's backend server 132, in order to be able to track and monitor the fleet, record status, raise alerts (if any) and generate waybills. The BOS 115 has the responsibility to interface with other management systems, so that the GPS and Wireless solution may be integrated with existing management systems seamlessly.

The BOS module or subsystem 115 may present the collected data to a user using a personal computer display. The personal computer display may be configured based on the detected enabled vehicle features for a particular vehicle and/or fleet of vehicles. The personal computer display may update the data of the enabled features detected in the vehicle allowing the user to monitor those features.

In the embodiment illustrated in FIG. 3, BOS or control system 115 basically comprises a server hardware module 140, storage and communication module 142, an application services module 144, and an operation console 145 for receiving commands from an operator 146 and providing data to the operator. Operation console 145 may comprise a touch screen or a display screen and keypad input device. The storage and communication module 142 includes a vehicle and GPS data communication client unit 146 which receives vehicle and GPS data from the GWU module 114, a VCS data communication server unit 148 for receiving communications from the VCS 110 and sending communications to the module 110, and a data base unit 150 linked to units 146 and 148 which receives and stores data from both modules in connection with each job or trip carried out by vehicles in the fleet. The VCS data communication server unit 148 may receive communication from the VCS through a mobile device receiving data from the VCS using BLUETOOTH technology and transmitting the data to the server using a wireless network including, but not limited to, WiFi, cellular, and/or a wireless wide area network.

The application services module 144 comprises a mapping, traffic and direction service module 151, a geo-fencing module 152, a vehicle data collection service module 154, a data/state logging service module 155, a waybill, payroll, and reporting service module 156, and a communication service module 158. The mapping, traffic and direction service module 150 communicates with websites over the Internet in order to receive current traffic delay information, and may communicate with external websites to receive mapping and direction information. Alternatively, mapping and direction software for the area covered by the fleet may be included in the BOS system 115.

The Geo-fencing module 152 defines the boundary of the jobs to be assigned at any one location. Geo-fencing areas are defined initially by an operator via a graphic user interface and can be updated anytime. Geo-fencing is used to improve the performance time from receiving the order to dispatch it to the mobile unit. This process is automated by the geo-fencing module. When a job is assigned, the geo-fencing module performs a check to determine whether it extends outside the defined geo-fencing area for the fleet service. If so, a notification is provided to the operator via the operation console. Any jobs assigned beyond the geo-fencing boundary must be justified (by a supervisor or any other senior personnel) and recorded.

Vehicle data collection service module 154 collects and monitors vehicle data on each vehicle in the fleet. When a vehicle is assigned to a job, this module checks the status of the vehicle using the data stored in data base 150 and notifies the operator if there are any areas of concern, such as maintenance due or the like. This module also monitors real time vehicle data received during a trip or job, such as mileage, gas, diagnostics, tire pressure, battery status and the like, and sends an alert to the operator when a potential problem or error is detected.

The data/state logging service module 155 reviews logging as well as vehicle position and status information received real time during a trip, and generates delay alerts which are provided to the operator if the vehicle is delayed or is detected to be not moving or off route.

Waybill, payroll, and reporting service module 156 generates various business and statistical reports based on information gathered on all vehicles in the fleet. The reports include billing statements, payroll reports, vehicle maintenance reports, customer rating/feedback reports, and the like. Communication service module 158 provides communication between the operator and the driver.

Figure 4:
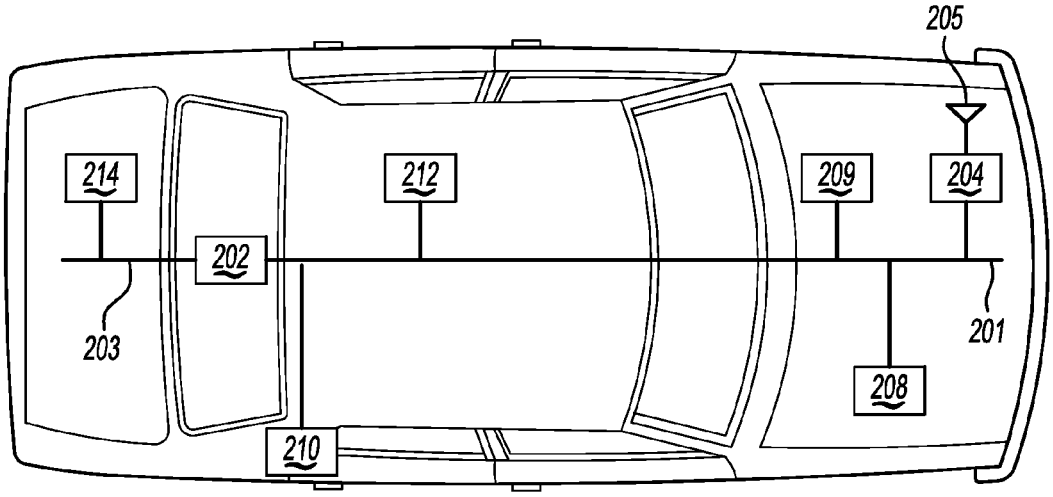
FIG. 4 is a block system architecture of a vehicle computing system querying one or more modules on the vehicle communication bus.

FIG. 4 is a block system architecture of a vehicle computing system querying one or more modules on a vehicle communication bus. A vehicle may be designed with a communication bus structure that allows electronic devices on the bus to communicate with each other and with device controllers and with other vehicle systems connected to the bus over bus connection nodes. The bus structure may operate using one or more proprietary communication protocols. A bus communication may include a controller area network allowing flexible network configurations based on different types of microprocessor and microcontroller.

A vehicle electrical system may include a vehicle bus 201 allowing the control modules to communicate with each other. The vehicle bus may be a linear configuration, as shown, or a closed ring configuration, to which various electronic devices are coupled. For example, the vehicle bus can be a Controller Area Network (CAN) or a fiber optic Media-Oriented Systems Transport ring bus (MOST), as are known in the art. The devices can communicate in a peer-to-peer configuration or one of the devices can act as a master device, wherein the other devices act as slave devices.

A gateway controller 202 of the vehicle bus 201 may provide communication with further modules 214 on a separately connected bus 203. Other electronic devices coupled to the vehicle bus 201 may include, but is not limited to, an engine control module 208, driver's information center 209 that includes a suitable display, for example a light emitting diode (LED) or liquid crystal (LC) display that may provide text and graphic information to the driver, a telematics control unit 204 having an antenna 205 to transmit and receive wireless communication, a vehicle control module 212 including steering wheel mounted switches, and HVAC controls, and a braking control module 210.

Each of the electronic devices is connected to the bus at a bus connection node. In addition, each of the electronic devices is individually addressable on the bus 201, and each device can further include memory for retaining operating information. During vehicle operation, each node on the bus can check for any other nodes on the bus to determine if the bus is operational. For example, the telematics control unit 204 may send a "check" message to a particular node or globally to all the nodes to obtain a response indicating that the bus is operational. If the bus is not operational, the bus can be shut down or the offending node can be disconnected from the bus for protection. Each node operates independently from the other nodes and contains its own operating system, application and message stack.

For example, if the telematics control unit 204 transmits a request for information from the engine control module 208, the application of the engine control module may direct an appropriate reply message from the message stack in the node to be sent on the vehicle bus 201.

The vehicle bus 201 using the gateway controller 202 may couple with other devices including, but not limited to, a cellular telephone, mobile device, navigation systems, infrared transceivers, personal computers, and/or communication/data ports. In addition, the devices coupled to the device bus 203. The devices coupled using the separately connected bus 203 may communicate on a peer-to-peer basis permitting the separate bus 203 to operate without a separate gateway controller. In another embodiment, the gateway bus 202 may not be necessary and the other devices may be coupled directly to another device/module (e.g. telematics controller unit) or to the vehicle bus 201 directly.

Each of the modules connected to the vehicle bus can be independent, having their own operating system and operational application. These modules may contain different vehicle features, controls and functions. For example, the telematics controller unit 204 having an antenna for allowing wireless communication between one or more mobile devices and the VCS. The telematics controller unit 204 may have source code enabling one or more telematics features and functions that may be turned on or turned off based on the options available in the vehicle and/or module.

When power is applied (i.e. starting the ignition of the vehicle and applying power to the vehicle communication bus), the bus master and/or the VCS may begin a module/device discovery procedure to determine what modules and/or devices are on the bus 201. For example, an initialization process of the VCS may request a discovery queries allowing modules and/or devices on a vehicle bus 201 to report identification. The identification may include which features are operating on the module and/or device. The module may report which features are operating based on the configuration settings which define the features the module may support or has enabled. For example, the query of configuration settings may be performed on a detected module by looking at one or more messages and/or variables. The module may transmit the configuration settings information using the bus 201 to one or more processers within the VCS. In another example the configuration settings may be available in the modules message stack.

In another embodiment, the VCS may receive a wireless request to initiate the bus master to begin a module and/or device discovery procedure querying for features and functions enabled on the module/device. The wireless request may be transmitted from a server and received by the VCS using one or more wireless technology including, but not limited to, WiFi, cellular, and/or BLUETOOTH communication. After the VCS has completed the querying for vehicle features, options, and functions enabled on the vehicle, it may transmit the data to one or more destinations including, but not limited to, a mobile device, server, wireless backend, and/or a backend office system. The VCS may wirelessly communicate the querying results using one or more wireless technologies including, but not limited to, WiFi, cellular, and/or BLUETOOTH technology.

Figure 5:
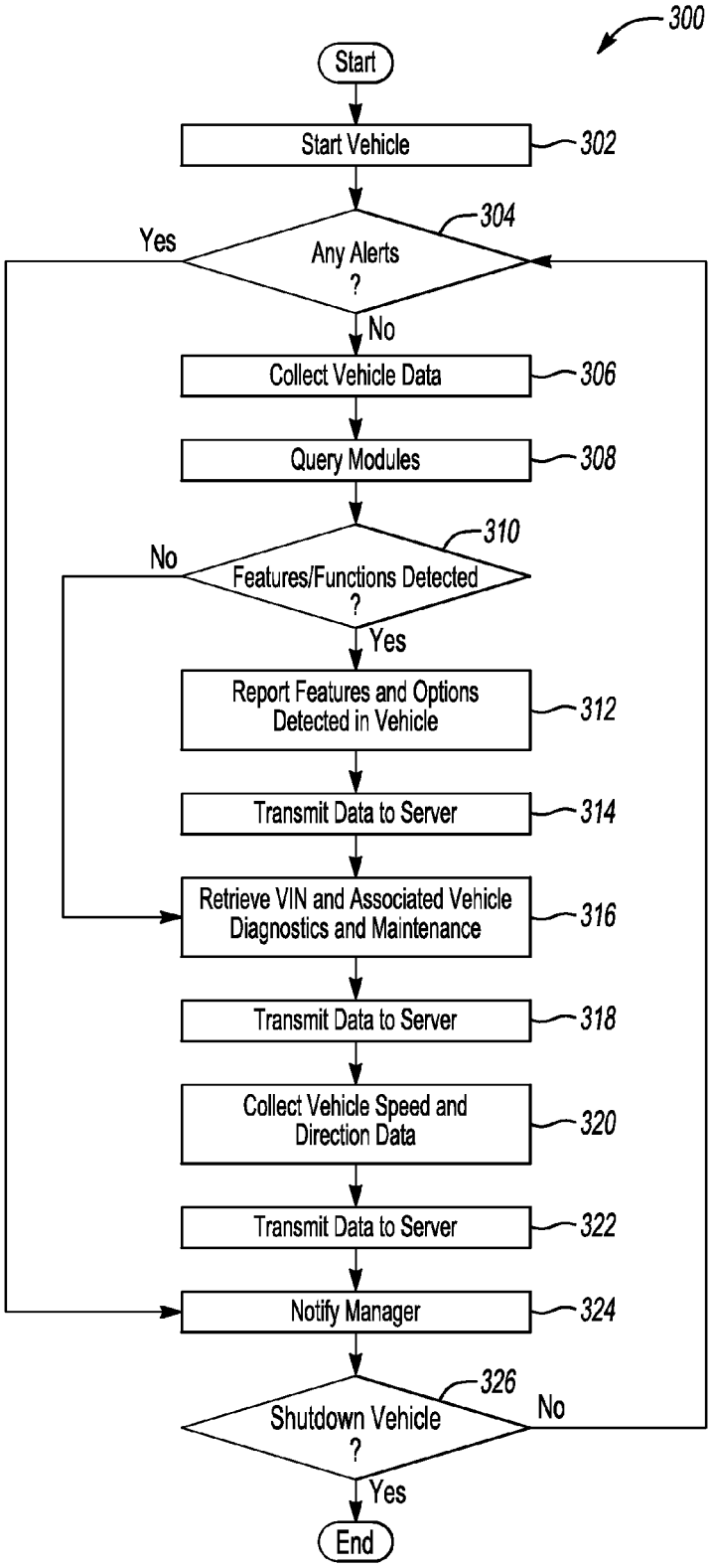
FIG. 5 is a flow chart illustrating an example method of a vehicle computing system querying one or more modules.

FIG. 5 is a flow chart illustrating an example method of a vehicle computing system querying one or more modules. The VCS querying one or more modules communicating in a vehicle may be implemented through a computer algorithm, machine executable code, non-transitory computer readable storage medium, or software instructions programmed into a suitable programmable logic device(s) of the vehicle, the entertainment module, the bus master, other controller in the vehicle, or a combination thereof. Although the various steps shown in the VCS querying one or more modules for enabled vehicle features 300 appear to occur in a chronological sequence, at least some of the steps may occur in a different order, and some steps may be performed concurrently or not at all.

At step 302, the vehicle computing system may be initialized using one or more process including, but not limited to, a driver entering a vehicle, a driver starting a vehicle, and/or a wireless signal received by the VCS to "wake-up" the one or more processors communicating in the vehicle. They VCS may check for any alerts once the system has been initialized at step 304. The alerts which may be stored or detected by the VCS may include vehicle maintenance alerts, traffic delay alerts, and/or geo-fencing alerts. The alerts may be transmitted to notify and inform a manager and/or driver at step 324. The VCS may notify the manager and/or driver using wireless technology to transmit to one or more mobile devices and/or a server. The VCS may transmit the alert notification using one or more wireless technologies including, but not limited to, WiFi, cellular, and/or BLUETOOTH.

At step 306, if no alerts are detected at the start of the trip and/or initialization of the VCS, the system may begin to collect vehicle data including, but not limited to, fuel level(s), vehicle mileage, and/or GPS data. In addition to the collection of vehicle data, the system may begin to initiate a query of vehicle modules and/or devices in communication with the VCS at step 308. The query of the one or more vehicle modules may transmit a request to each module to broadcast its configuration settings which may define the features it is supporting or has enabled. In one embodiment, the VCS may query a vehicle module and/or device of enabled vehicle features by monitoring vehicle data bus traffic to determine which features are operating. In another embodiment, the VCS may determine enabled vehicle features by reading vehicle data bus configuration messages that are exchanged on the bus between one or more modules.

At step 310, the system may gather the querying information and sort the vehicle features and functions that are detected. If the system detects one or more vehicle features and/or functions, it may generate a report listing the results at step 312. The report may be package in a data format for wireless transmission to a server at step 314.

If no feature or functions were detected by querying the one or more modules/devices communicating with the VCS, the system may retrieve and decode the vehicle identification number (VIN) to determine which features and/or functions are enabled in the vehicle at step 316. The system may use the VIN to determine if a vehicle feature is enabled based on decoding the build codes embedded in the identification. The system may also use the VIN in addition to the querying results to determine the enabled vehicle features, functions and options on a vehicle.

Additional data may be retrieved including vehicle diagnostics and/or maintenance notices at step 316. The VIN, vehicle diagnostics and maintenance messages may be wireless transmitted to a server at step 318. The VIN and/or additional data may be transmitted to the server for additional analysis.

At step 320, the system may collect vehicle speed and directional data while continuously monitoring all types of alerts throughout the trip. The system may transmit the collected vehicle speed and directional data to the server at step 322. The data collected may be transmitted to a server, backend server, mobile device, and/or a backend office system. The data collected may be transmitted using one or more wireless technologies including, but not limited to, WiFi, cellular, and/or BLUETOOTH technology.

At step 324, the collected data may be transmitted to notify and inform a manager and/or driver. The notification to the manager and/or driver may be presented on one or more output devices including, but not limited to, a mobile device, a vehicle's driver information center, and/or presented at a webpage. The collected data may be transmitted to the one or more output devices using wireless technology including, but not limited to, WiFi, BLUETOOTH, and/or cellular.

At step 326, the system may continuously collect data, query modules, and/or report alerts to a driver and/or manager during a key cycle. The key cycle begins when the VCS is initialized and may end when the VCS shutdowns. If the VCS shutdowns (e.g. powers down), the system may end the querying of one or more modules.

Figure 6:
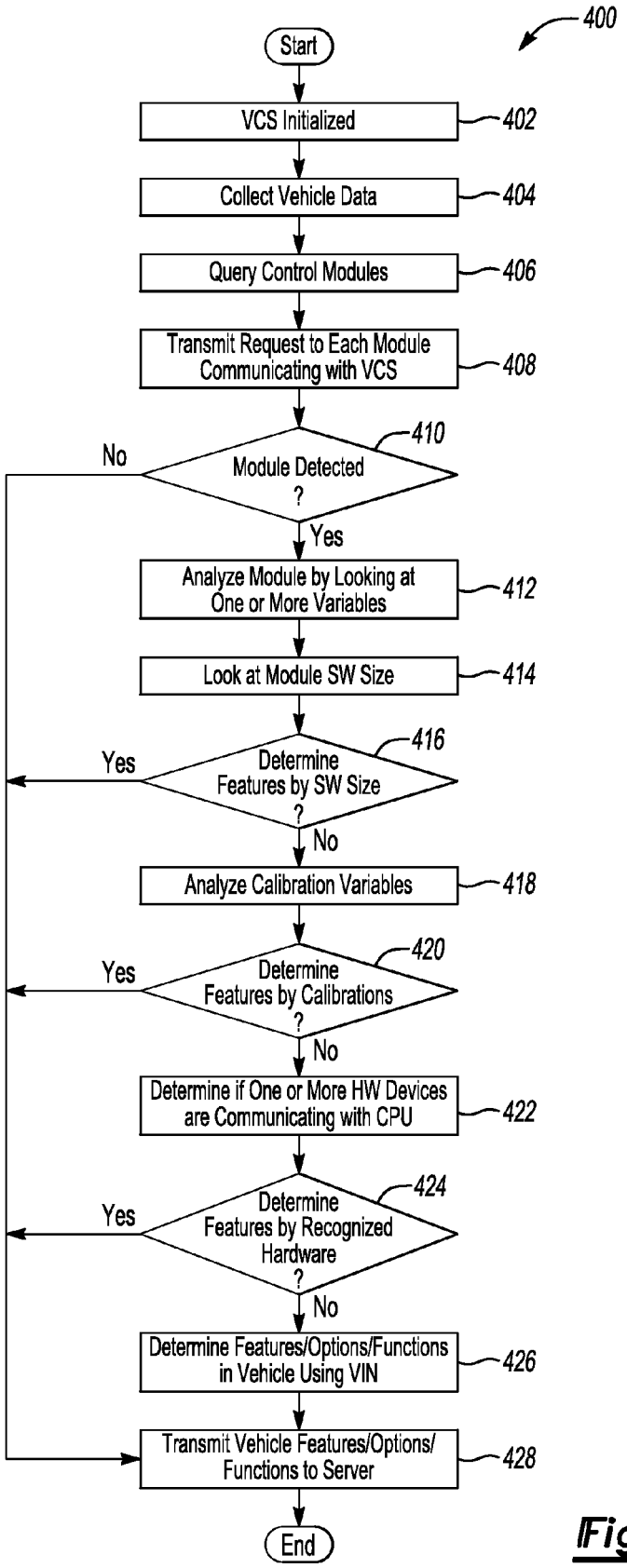
FIG. 6 is a flow chart illustrating an example method of determining enabled vehicle features on a module in a vehicle computing system.

FIG. 6 is a flow chart illustrating an example method of determining enabled vehicle features 400 on a module in a vehicle computing system. The vehicle computing system may have one or more processers communicating to enable vehicle features, functions, and options. The vehicle features, functions, and options may include, but is not limited to, anti-lock braking, traction control, telematics options (e.g. Microsoft Sync), navigation, heated seats, air conditioned seats, and/or a moon roof, just to name a few. These vehicle features, functions, and options may be controlled and enabled by one or more modules and/or devices communicating in the VCS. The communication between these modules may be enabled using a vehicle data bus (e.g. CAN bus).

At step 402, the VCS may be initialized by transmitting a signal to one or more modules. An example of initializing the VCS may occur when an occupant has entered the vehicle and/or has enabled the ignition of the vehicle. Once the VCS initialization process starts, the system may communicate to the one or more modules to begin collecting data at step 404. The collected vehicle data process may include, but is not limited to, diagnostics, maintenance, vehicle location, speed, and/or general vehicle information (e.g. VIN).

At step 406, the system may receive a message from a fleet management system to begin querying the one or more modules for enabled vehicle features and functions. The system may transmit a querying request to each module communicating with the VCS at step 408. The query of vehicle modules may be done using a vehicle data bus and/or using wireless communication technology. The system may determine if one or more modules are detected at step 410.

At step 412, once detected, the module communicating within a vehicle system may be analyzed based on one or more variables within the module's embedded software. The one or more variables within the module's embedded software may include, but is not limited to, configuration variables, settings, and/or hardware identification. If no additional modules are detected, the system may exit the query while transmitting the collected data and determined vehicle features and functions to a server at step 428.

At step 414, the system may determine one or more enabled vehicle features and/or functions based on analysis of the software size on the detected module. The system may compare software size on a detected module to determine whether or not the module has the software to implement one or more features or functions at step 416. For example, the brake control module may be detected and during analysis of the software size on the module, it may be determined that the brake control module may have the anti-lock brake feature. It may also be determined based on the analysis of the brake control module software size that the module does not have software to implement traction control.

At step 428, if the system is able to determine one or more enabled features and/or functions of the module based on software size, the system may transmit the vehicle feature and/or function to a server. If the system is unable to determine if the module has enabled one or more vehicle features, functions and/or options at the detected module based on software size, then the system may perform an analysis of calibration variables embedded in the module at step 418.

At step 420, the system may determine if a calibration variable and/or value is configured to implement a certain vehicle feature, function or option based on a calibration bit(s) and/or byte(s) enabled in the software. For example, the vehicle control module may be detected allowing the system to determine that the calibration bits are turned on to enable heat seats in the vehicle. If a vehicle feature is determined based on the calibrations, the system may transmit a wireless signal to a server indicating of the enabled vehicle feature. If the system is unable to determine if the module has enabled one or more vehicle features, functions and/or options at the detected module based on calibrations, the system may analyze the recognized hardware embedded on the module at step 422.

At step 424, the system may determine one or more enabled feature and/or functions of the detected module based on hardware configuration and analysis. The system may determine a feature based on hardware recognition of a certain module or control that enables a specific vehicle feature. For example, the system may detect the Telematics controller unit to have a SYNC module communicating with the VCS. If the system detects and recognizes a piece of hardware associated with a vehicle feature, function, and/or option, it may transmit the collected information to a server at step 428.

At step 426, the system may determine additional vehicle functions and/or features based on the VIN. The VIN may be encoded with information related to the vehicle assembly including, but not limited to, vehicle features, functions, and options. For example, the VIN may be decoded to obtain information including, but not limited to, engine type and size, transmission type, differential, and/or torque converter with their associated control modules. The system may transmit the collected vehicle features of the one or more enabled vehicle features and systems to a server at step 428.

Figure 7:
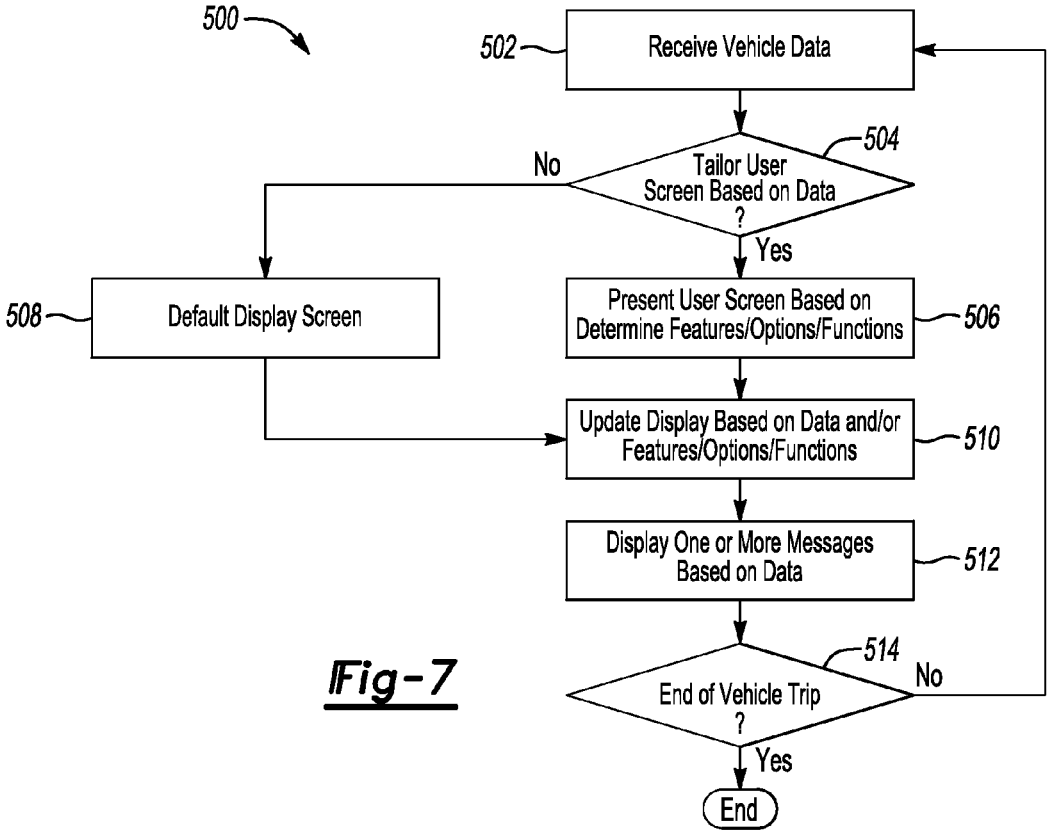
FIG. 7 is a flow chart illustrating an example method of tailoring a user screen in response to one or more vehicle features detected within a vehicle computing system.

FIG. 7 is a flow chart illustrating an example method of tailoring a user screen 500 in response to one or more vehicle features detected within a vehicle computing system. The user interface screen may allow a user or a fleet manager to review vehicle data including, but not limited to, vehicle location (GPS), vehicle maintenance, and/or vehicle alerts and diagnostic messages. The interface screen may be present to a user based on received data regarding the vehicle's features, options, and functions enabled in the vehicle. The user interface allows a user to select from various options such as searching vehicle features, generating reports, and monitoring vehicle location and performance.

At step 502, the server and/or operating system may receive vehicle data collected from the VCS. The user screen may be tailored based on the received data collected by the VCS at step 504. If the screen is not tailor specifically for the identified vehicle with the detected module having an enabled vehicle feature, the user screen may be set to a default screen at step 508. The default screen may allow for generic updates based on data receive and/or the default features, options, and/or functions of that vehicle.

For example, the default user screen may include, but is not limited to a map tracking screen that shows the vehicle location based on GPS. The default screen may also allow for an alert monitoring screen to pop up to show any alerts generated by one or more diagnostics and/or features including the geo-fencing service module. The geo-fencing service module may alert a user if the vehicle has gone outside a designated area. The default user screen may also present vehicle data collection such as low gas, low battery, maintenance overdue, and or low tire pressure.

At step 506, if the server and/or operating system received vehicle data recognizing one or more enabled features, functions and options located on the vehicle, the user screen may be tailored to these determined features. For example, if the server and/or operating system received vehicle data that reports the vehicle includes traction control as a vehicle feature, the user screen may present a tailored screen with information regarding traction control. The tailor user screen may inform the user the current status of traction control, for example, if the driver has manually disabled the feature. Another example of the tailored user screen for the traction control may be maintenance information regarding the vehicle feature including, but not limited to, software updates being offer by the vehicle OEM.

At step 510, the user screen may continuously be updated with data received from a vehicle during a trip. The user screen may allow for one or more messages to be displayed on the screen once they are received from the vehicle at step 512. The one or more messages to be displayed based on received data allows for certain data to be displayed when a fault, error or violation has occurred including, but not limited to, diagnostic messages, geo-fencing violations, and/or maintenance reminders.

The user screen may continuously be updated based on the received data during a vehicle trip at step 514. If the vehicle trip is over, the user screen may allow the user to review the data already received. For example, if the vehicle trip has ended, the user may review the data received and stored in the database. This may allow the user to understand preventive maintenance issues, the current status of the vehicle, and/or review of past vehicle abuses.

Figure 8:
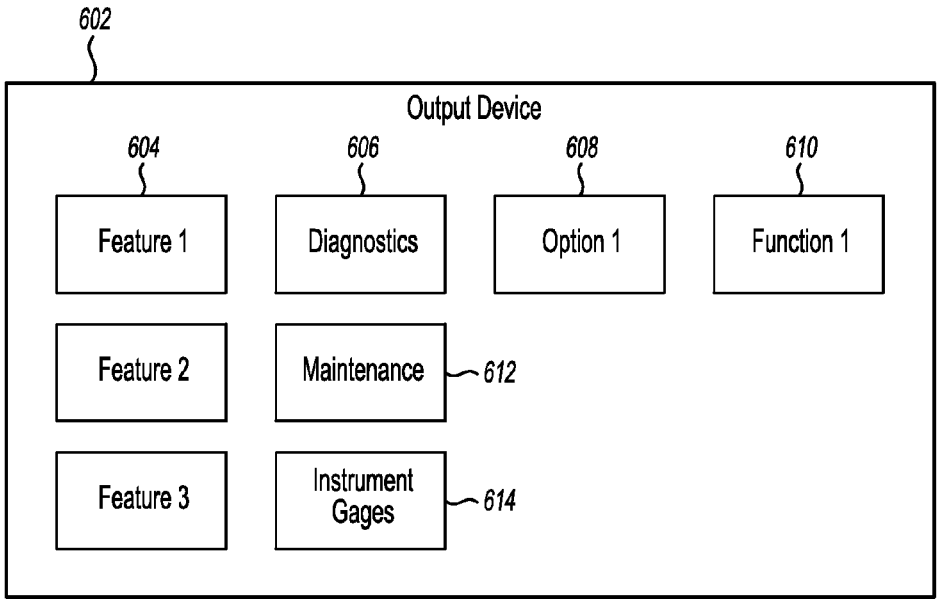
FIG. 8 is a block diagram of information being presented on an output device in response to the one or more vehicle features.

FIG. 8 is a block diagram of information being presented on an output device in response to the one or more vehicle features. The output device 602 may include, but is not limited to, a mobile device, personal computer, and/or an in-vehicle center console LCD screen. The output device may receive wireless transmission of data from a vehicle using one or more wireless technologies including, WiFi, BLUETOOTH, and/or cellular.

The output device may display vehicle data including, but not limited to, vehicle features 604, diagnostics 606, vehicle options 608, vehicle functions 610, maintenance 612 and/or instrument gages 614. The output device may be in communication with one or more servers and databases. The fleet manager or user may receive information from the vehicle during a trip or review the received data from a previous trip from vehicle data stored in the one or more databases.

The output device display may tailor the display based on the received data from the VCS including, but not limited to, the querying of modules to determine enabled vehicle features and/or functions. The output device may transmit a message to the VCS during a vehicle trip to initiate a query of the modules to receive data regarding the vehicle features and/or functions associated with the vehicle. The output device may receive a wireless message from the VCS and update the display on the output device.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fleet management system comprising:

a first processor configured to:

wirelessly receive an initialization signal originating from a fleet management server in communication with the first processor;

responsive to the initializing signal, query vehicle modules for enabling data indicating optional features installed in a vehicle, wherein the query is based on one or more criteria;

wirelessly transmit a signal indicating the installed features to the fleet management server;

wherein the fleet management server is configured to tailor a user screen responsive to indicated installed features received from the first processor.

2. The fleet management system of claim 1 wherein the one or more criteria includes comparing a module software size.

3. The fleet management system of claim 1 wherein the one or more criteria includes analysis of calibration variable settings.

4. The fleet management system of claim 1 wherein the one or more criteria includes hardware configuration.

5. The fleet management system of claim 1 wherein the server is configured to output the enabled features to a cellular phone.

6. The fleet management system of claim 1 wherein the server is configured to output the enabled features to a personal computer.

7. The fleet management system of claim 1 wherein the query based on one or more criteria includes a query of one or more configuration settings for the module.

8. A computer-implemented method comprising:

wirelessly receiving an initialization signal from a fleet management server;

querying vehicle modules for enabling data indicating optional features installed in a vehicle, responsive to the initialization signal on a vehicle data bus, the query being based on one or more criteria;

wirelessly transmitting a signal indicating the installed features to the fleet management server; and tailoring an output display at the fleet management server based on the indicated installed features.

* * * * *